US010766298B2

(12) United States Patent
Smith, III et al.

(10) Patent No.: US 10,766,298 B2
(45) Date of Patent: Sep. 8, 2020

(54) SYSTEM FOR AESTHETICALLY DISPENSING MELTED WAX

(71) Applicants: James Francis Smith, III, Tega Cay, SC (US); Rajeev B Kulkarni, Charlotte, NC (US)

(72) Inventors: James Francis Smith, III, Tega Cay, SC (US); Rajeev B Kulkarni, Charlotte, NC (US)

(73) Assignees: Rajeev Kulkarni, Charlotte, NC (US); James Francis Smith III, Tega Cay, SC (US)

( * ) Notice: Subject to any disclaimer, the term of this patent is extended or adjusted under 35 U.S.C. 154(b) by 73 days.

(21) Appl. No.: 16/182,524

(22) Filed: Nov. 6, 2018

(65) Prior Publication Data

US 2019/0135025 A1 May 9, 2019

Related U.S. Application Data

(60) Provisional application No. 62/582,014, filed on Nov. 6, 2017, provisional application No. 62/587,625, filed on Nov. 17, 2017.

(51) Int. Cl.

| | |
|---|---|
| ***B44B 3/06*** | (2006.01) |
| ***B43K 19/00*** | (2006.01) |
| ***B44D 3/24*** | (2006.01) |

(52) U.S. Cl.

CPC ..... *B44B 3/06* (2013.01); *B43K 19/00* (2013.01); *B44D 3/24* (2013.01)

(58) Field of Classification Search

CPC .. B44B 3/06; B44B 3/00; B44B 3/063; B44B 2700/00; B43K 19/00; B43K 29/00; B43K 29/20; A46B 11/08; A46B 11/00; A46B 11/0068; B44D 3/24; B44D 3/00; B44D 3/22; B44D 3/225; B29C 39/02

See application file for complete search history.

(56) References Cited

U.S. PATENT DOCUMENTS

| | | | | |
|---|---|---|---|---|
| 5,151,575 A * | 9/1992 | Lilly | B29C 67/0044 | 156/499 |
| 7,052,261 B2 * | 5/2006 | Fernandez | A63H 33/001 | 425/136 |
| 7,748,919 B2 * | 7/2010 | Gueret | A45D 40/18 | 401/1 |

* cited by examiner

*Primary Examiner* — David J Walczak

(57) ABSTRACT

A system that aesthetically dispenses melted wax includes a plurality of elongated heating cases, a plurality of wax cartridges, and a plurality of transfer canisters. The plurality of elongated heating cases is used to heat up wax or similar crayon material which is placed inside of the plurality of wax cartridges. The plurality of wax cartridges is used to hold wax or similar crayon material. The plurality of transfer canisters is used to store the plurality of wax cartridges when not in use and to transfer a wax cartridge from the plurality of wax cartridges into an elongated heating case of the plurality of elongated heating cases.

17 Claims, 11 Drawing Sheets

SYSTEM FOR AESTHETICALLY DISPENSING MELTED WAX

The current application claims a priority to the U.S. Provisional Patent application Ser. No. 62/582,014 filed on Nov. 6, 2017 and a priority to the U.S. Provisional Patent application Ser. No. 62/587,625 filed on Nov. 17, 2017.

FIELD OF THE INVENTION

The present invention relates generally to artistic instruments. More specifically, the present invention is a system for aesthetically dispensing melted wax for the purposes of drawing, coloring, sketching and artwork.

BACKGROUND OF THE INVENTION

Crayons, a coloring aid, is made up of different formulations and colors of waxes. For the purposes of drawing, coloring, sketching and artwork, these are held by a human hand and scrubbed directly on the art surface which can be paper, canvas, cloth, etc. The general traits of this manual process are: The coloring patterns are generally random with lots of in-between white spaces. The artwork does not look to be uniformly colored, vibrant, or striking. It is slow process. The crayons break leaving shorter lengths behind, and they generally go waste are discarded. Additionally, once the crayon gets shorter than a length where it cannot be held comfortably in the hand, it has to has to be discarded. Consequently, a complete crayon is almost never utilized. The manual process of holding crayons transfers wax and color on to the hands and make them messy. Only a single color can be used at a time and different colors cannot be mixed to create new colors.

The present invention provides an automated pen where crayons are inserted into cold or warm cartridges placed in a docking case. These cartridges are then picked up by the present invention and heated rapidly to deliver liquid wax via its tip. The present invention thus helps the user complete any artwork or other project with liquid wax. The processes of changing colors or wax materials can be achieved by switching cartridges using a docking case. This process overcomes the unfavorable traits listed previously. The specific benefits of the present invention include, but are not limited to: liquid wax yields uniform, vibrant and striking wax paintings. The process is relatively much faster. Melted crayons do not break and are consumed in its entirety. If a melted crayon is not completely consumed, the cartridge can be re-inserted, and the remaining portion can be completely consumed in the future. As such there is no waste. Since the crayon is not held in the bare hand, there is no wax or color transfer onto the hands and fingers. Different colored crayon pieces can be inserted into the same cartridge to create new colors of liquid wax.

DETAIL DESCRIPTIONS OF THE INVENTION

All illustrations of the drawings are for the purpose of describing selected versions of the present invention and are not intended to limit the scope of the present invention.

Figure 1:
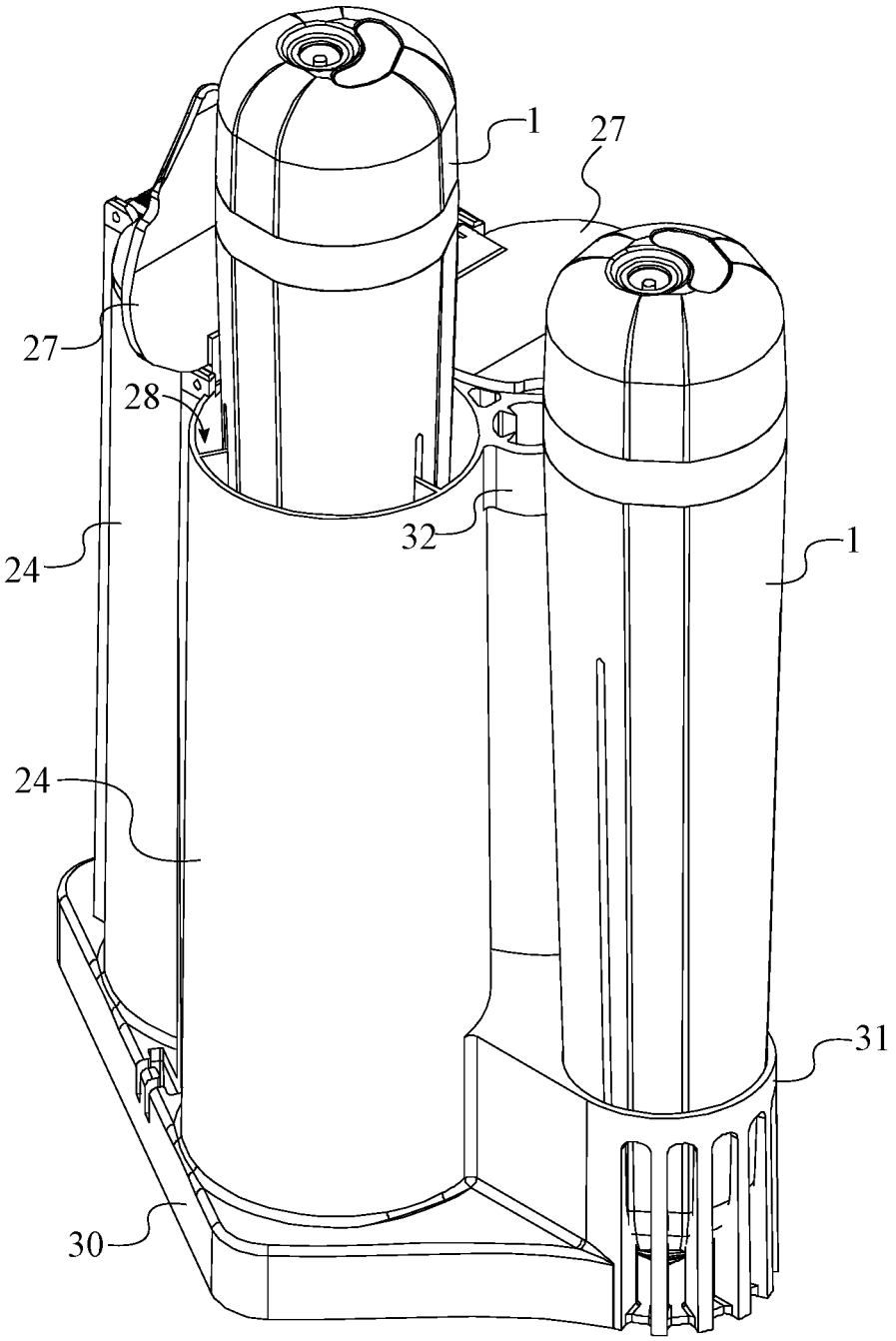
FIG. 1 is a perspective view of the present invention.

The present invention is a system for aesthetically dispensing melted wax. In further detail, the present invention provides a pen that can dispense melted wax. In reference to FIGS. 1 and 2, the present invention comprises a plurality of elongated heating cases 1, a plurality of wax cartridges 17, and a plurality of transfer canisters 24. The plurality of elongated heating cases 1 is used to heat up wax or similar crayon material which is placed inside of the plurality of wax cartridges 17. The plurality of wax cartridges 17 is used to hold wax or similar crayon material. The plurality of transfer canisters 24 is used to store the plurality of wax cartridges 17 when not in use and to transfer a wax cartridge from the plurality of wax cartridges 17 into an elongated heating case of the plurality of elongated heating cases 1.

Figure 2A:
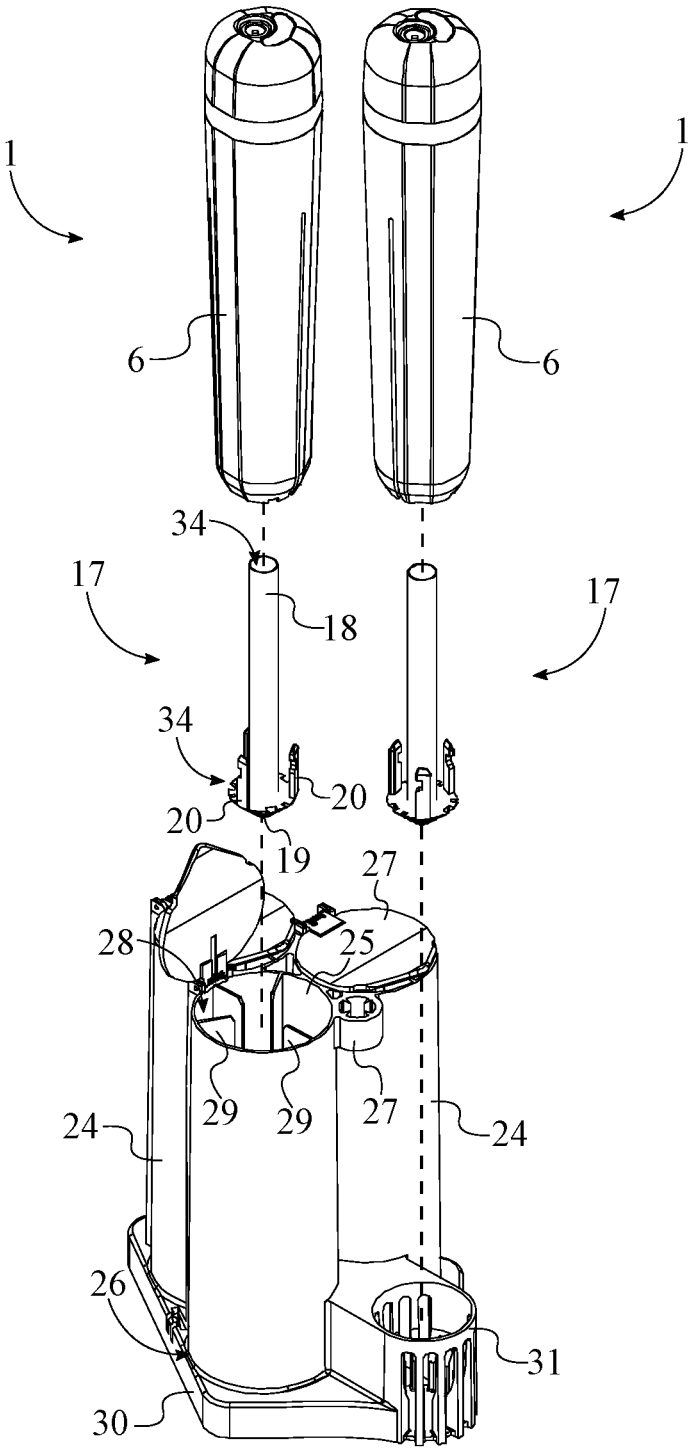
FIG. 2A is an exploded perspective view of the present invention.
Figure 2B:
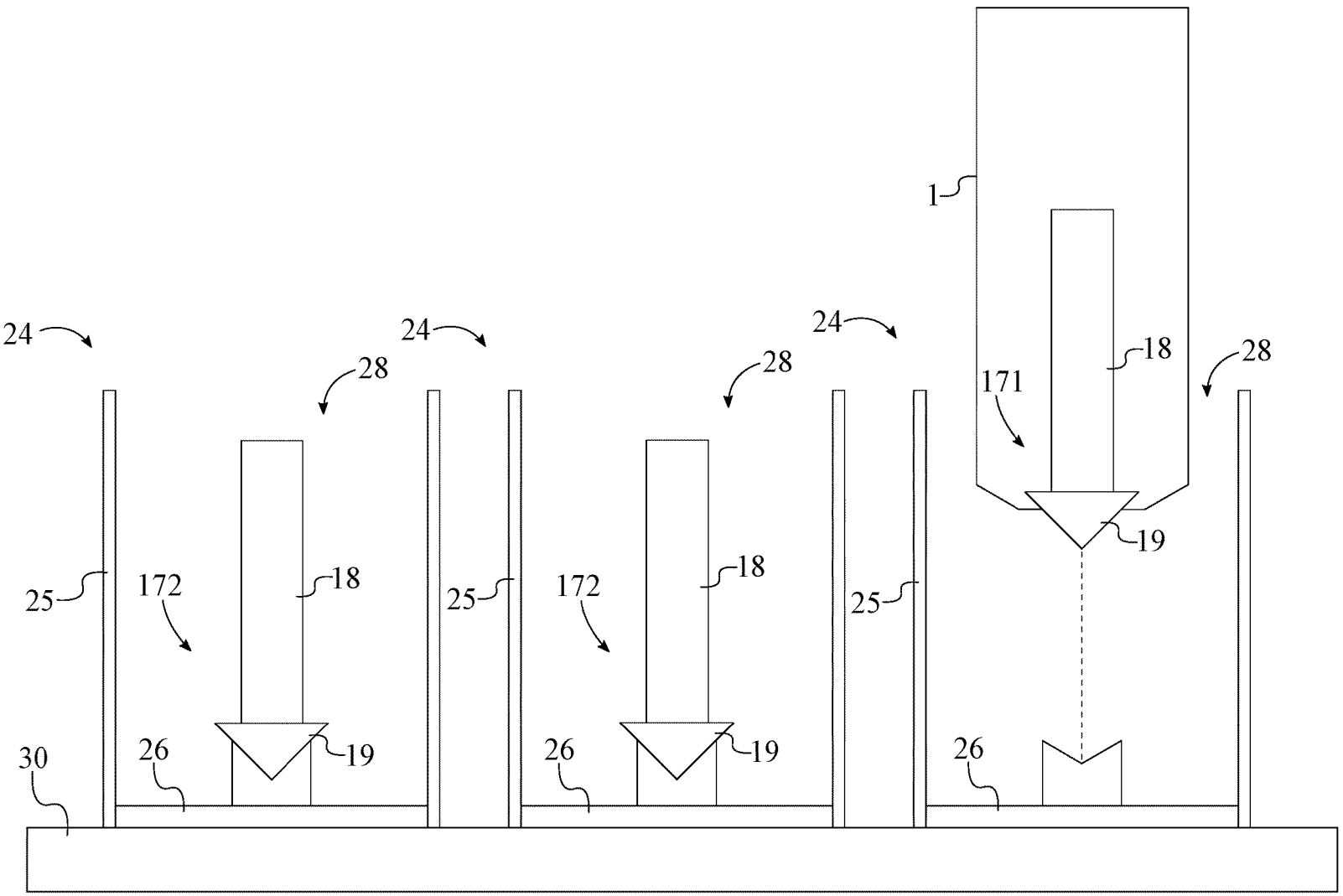
FIG. 2B is a schematic diagram illustrating the system of the present invention.

The general configuration of the aforementioned components allows the present invention to efficiently and effectively dispense melted wax for artistic purposes. With reference to FIGS. 2A and 2B, the plurality of wax cartridges 17 comprises at least one selected cartridge 171 and a plurality of unselected wax cartridges 172. The at least one selected cartridge 171 is heated to dispense melted wax. The plurality of unselected cartridge 171*s* is on standby to be used for dispensing melted wax. The user can insert any color or type of wax or similar crayon material into the at least one selected cartridge 171. Each of the plurality of unselected wax cartridges 172 is mounted within a corresponding canister from the plurality of transfer canisters 24. This arrangement allows each of the unselected wax cartridges 172 to be properly stored. The at least one selected cartridge 171 is operatively engaged into at least one activated case form the plurality of elongated heating cases 1, wherein the at least one activated case is used to hold and heat the at least one selected cartridge 171. This arrangement allows the at least one selected cartridge 171 to be fully secured into the at least one activated case. The at least one selected cartridge 171 can be operatively engaged into the at least one activated case through various fastening methods such as, but not limited to, latch fasteners or threaded fasteners.

Figure 4:
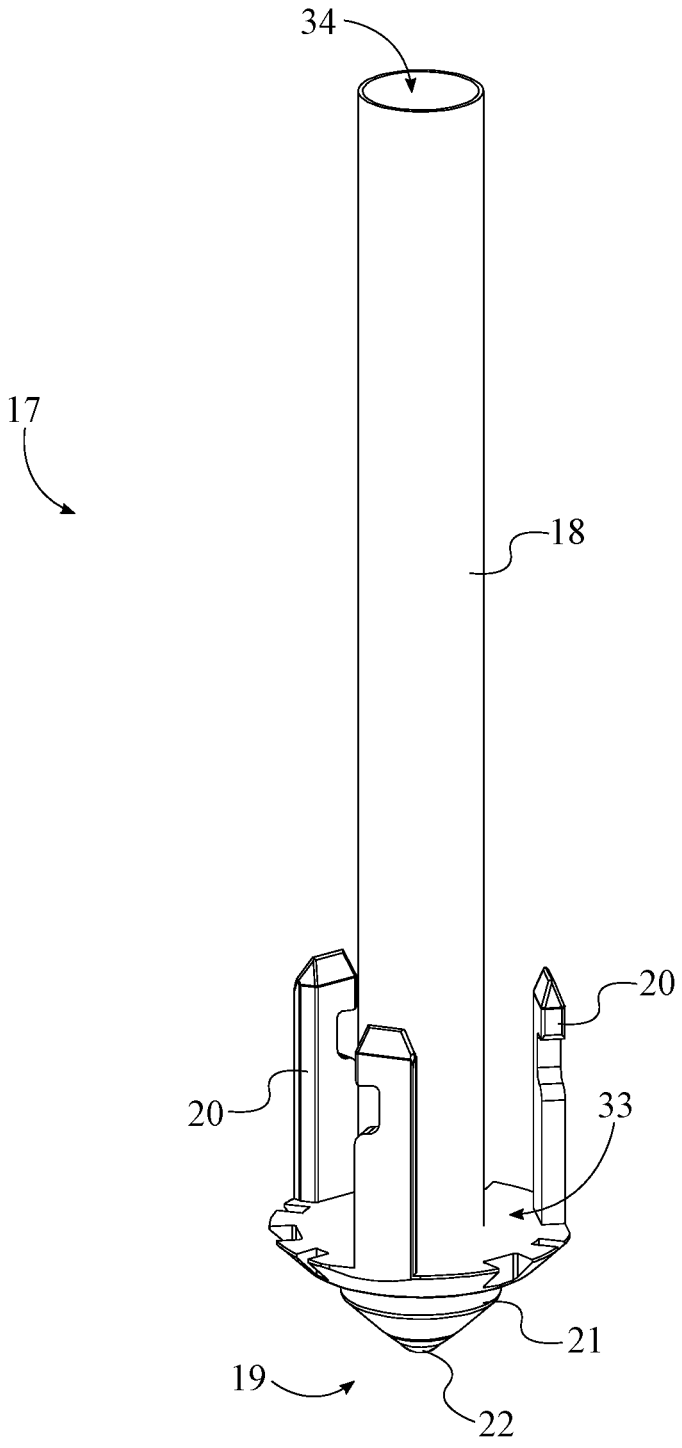
FIG. 4 is a perspective view of the wax cartridge.

With reference to FIG. 4, each of the plurality of wax cartridges 17 further comprises a heat-receiving tube 18, a drawing tip 19, and a plurality of strike plates 20. The heat-receiving tube 18 is used to hold wax or similar crayon material that will be heated. The drawing tip 19 provides a means to dispense the melted wax. The plurality of strike plates 20 is a set of fastening features that allows the at least one selected cartridge 171 to be engaged into the at least one activated case. The heat-receiving tube 18 comprises a first open end 33 and a second open end 34. The first open end 33 and the second open end 34 are reference ends of the heat-receiving tube 18. The drawing tip 19 being in fluid communication with the heat-receiving tube 18 in order to allow the melted wax or similar crayon material to flow from the heat-receiving tube 18 and be dispensed by the drawing tip 19. The drawing tip 19 is mounted adjacent to the first open end 33. This arrangement properly positions the drawing tip 19 at the bottom of the heat-receiving tube 18. The plurality of strike plates 20 is connected around the drawing tip 19 and oriented towards the second open end 34. This arrangement properly positions and orients the plurality of strike plates 20 in order for at least one selected cartridge 171 to be engaged into the at least one activated case. In order for the plurality of unselected wax cartridges 172 to be properly secured within the corresponding canister and with reference to FIGS. 2B and 8, the drawing tip 19 for each of the plurality of unselected wax cartridges 172 is mounted onto a base 26 of the corresponding canister. In more detail and in a preferred embodiment of the present invention, each of the plurality of unselected wax cartridges 172 is mounted onto the base 26 of the corresponding canister by an O-ring. The O-ring provides a resistance force which maintains each of the plurality of unselected wax cartridges 172 onto the base 26 of the corresponding canister.

Figure 6:
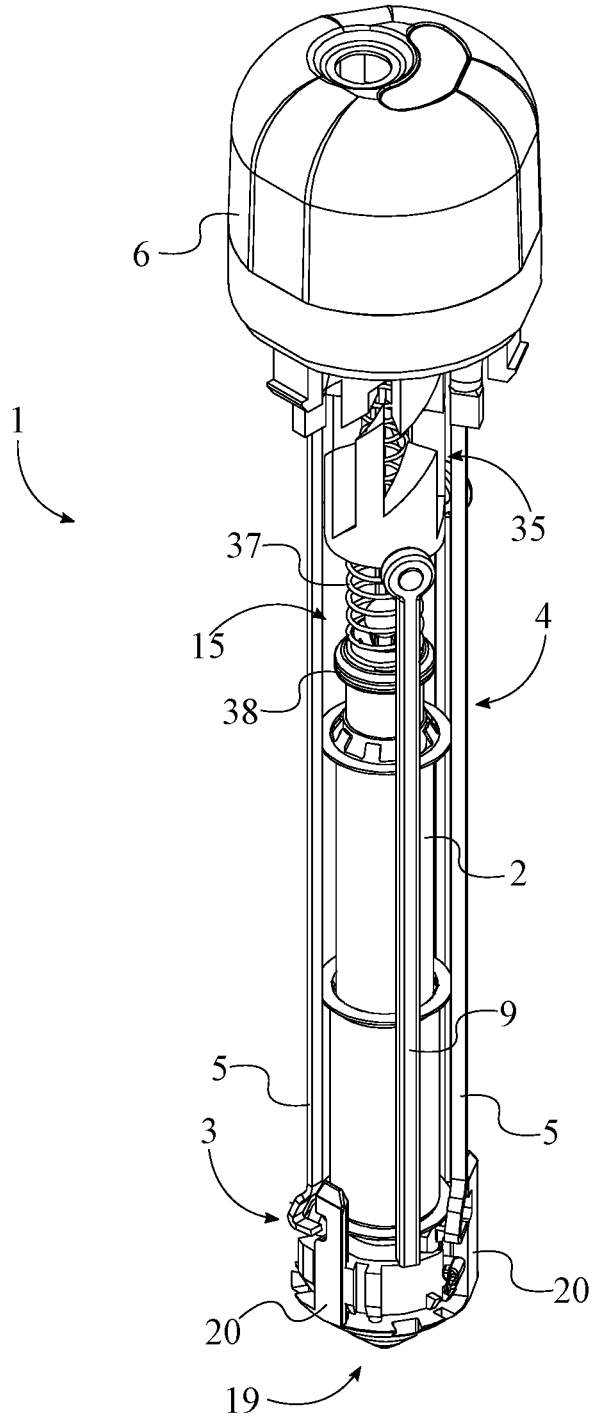
FIG. 6 is perspective view illustrating the internal mechanisms of the elongated heating case.

With reference to FIG. 6, each of the plurality of elongated heating cases 1 comprises a heating tube 2, a prong-actuated push mechanism 9, a cam-type rotation mechanism 35, and a plurality of spring-loaded latches 5. The heating tube 2 is used to receive the heat-receiving tube 18 of the selected cartridge 171 when engaged to the activated case. The plurality of spring-loaded latches 5 is a set of fastening features that allows the activated case to readily engage with the selected cartridge 171. The heat-receiving tube 18 of the selected cartridge 171 is sleeved by the heating tube 2 of the activated case in order for the activated case to heat the selected cartridge 171. The drawing tip 19 of the selected cartridge 171 is terminally positioned to the heating tube 2 of the activated case in order for the drawing tip 19 to properly dispense melted wax from inside of the activated case. The prong-actuated push mechanism 9 is operatively coupled to the cam-type rotation mechanism 35, wherein the prong-actuated push mechanism 9 is used to input linear motion into the cam-type rotation mechanism 35. The cam-type rotation mechanism 35 is operatively coupled to each of the plurality of spring-loaded latches 5, wherein the cam-type rotation mechanism 35 is used to output motion to selectively engage or disengage each of the plurality of the spring-loaded latches 5 of the activated case to a corresponding plate from the plurality of strike plates 20 of the selected cartridge 171. In more detail, the prong-actuated push mechanism 9 comprises a plurality of push rods, and the cam-type rotation mechanism 35 comprises an upper cam and a lower cam. Each of the plurality of push rods is laterally connected to the lower cam. This arrangement allows the push rods to move the lower cam in order to engage the upper cam. Each of the plurality of spring-loaded latches is laterally connected to the upper cam. When the upper cam is engaged by the lower cam, the upper cam begins to rotate and moves to either a first discrete rest state or a second discrete rest state. This consequently allows each of the plurality of spring-loaded latches 5 of the activated case to be engaged to or disengaged from a corresponding plate from the plurality of strike plates 20 of the selected cartridge 171.

With reference to FIG. 4, each of the plurality of wax cartridges 17 further comprises a drawing barrel 21. Additionally and with reference to FIG. 7, each of the plurality of heating cases 1 comprises a heat-insulated shell 6, a cam-type retraction mechanism 7, and an actuation button 8. The drawing barrel 21 is used to mount the drawing tip 19 to the first open end 33. The heat-insulated shell 6 allows a user to grip the at least one activated case without getting burned by the heating tube 2. The drawing barrel 21 is connected adjacent to the first open end 33 in order to properly mount the drawing tip 19. The drawing tip 19 is slidably mounted within the drawing barrel 21 in order for the drawing tip 19 to freely be retracted into or extend out from the drawing barrel 21. The cam-type retraction mechanism 7 is mounted within the heat-insulated shell 6 in order to be properly maintained inside the at least one activated case. The actuation button 8 is externally integrated into the heat-insulated shell 6 in order to be easily accessed by a user. The second open end 34 of the at least one selected cartridge 171 is operatively engaged to the cam-type retraction mechanism 7 of the at least one activated case, wherein the cam-type retraction mechanism 7 is used to retract the drawing tip 19 into the drawing barrel 21 or issued to extend the drawing tip 19 out of the drawing barrel 21. This arrangement allows the user to retract the drawing tip 19 when not being used for safety purposes and to extend the drawing tip 19 in order to dispense melted wax. The actuation button 8 is operatively coupled to the cam-type mechanism retraction mechanism 7, wherein the actuation button 8 is used to actuate the cam-type retraction mechanism 7. This arrangement allows a user to easily and conveniently actuate the cam-type retraction mechanism 7 which further retracts or extends the drawing tip 19 into or from the drawing barrel 21.

With reference to FIG. 4, each of the plurality of wax cartridges 17 further comprises a ballpoint valve 22 in order to prevent unwanted melted wax from leaking out from the drawing tip 19. The ballpoint valve 22 is operatively integrated into the drawing tip 19, wherein the ballpoint valve 22 is used to selectively dispense melted wax from the drawing tip 19. This arrangement properly positions the ballpoint valve 22 in order for the ballpoint valve 22 to prevent unwanted melted wax from leaking out from the drawing tip 19. This adds a safety feature to the present invention where melted wax is not accidentally dispensed to burn a user. In further detail, the ballpoint valve 22 includes a spring-loaded ball. When the user presses the drawing tip 19 against a surface thereby applying pressure to the ballpoint valve 22, the spring-loaded ball moves into an opened state which allows melted wax to flow from the drawing tip 19. When pressure is released from the ballpoint valve 22, the spring-loaded ball moves into a sealed state which prevents melted wax from flowing out of the drawing tip 19.

Figure 9:
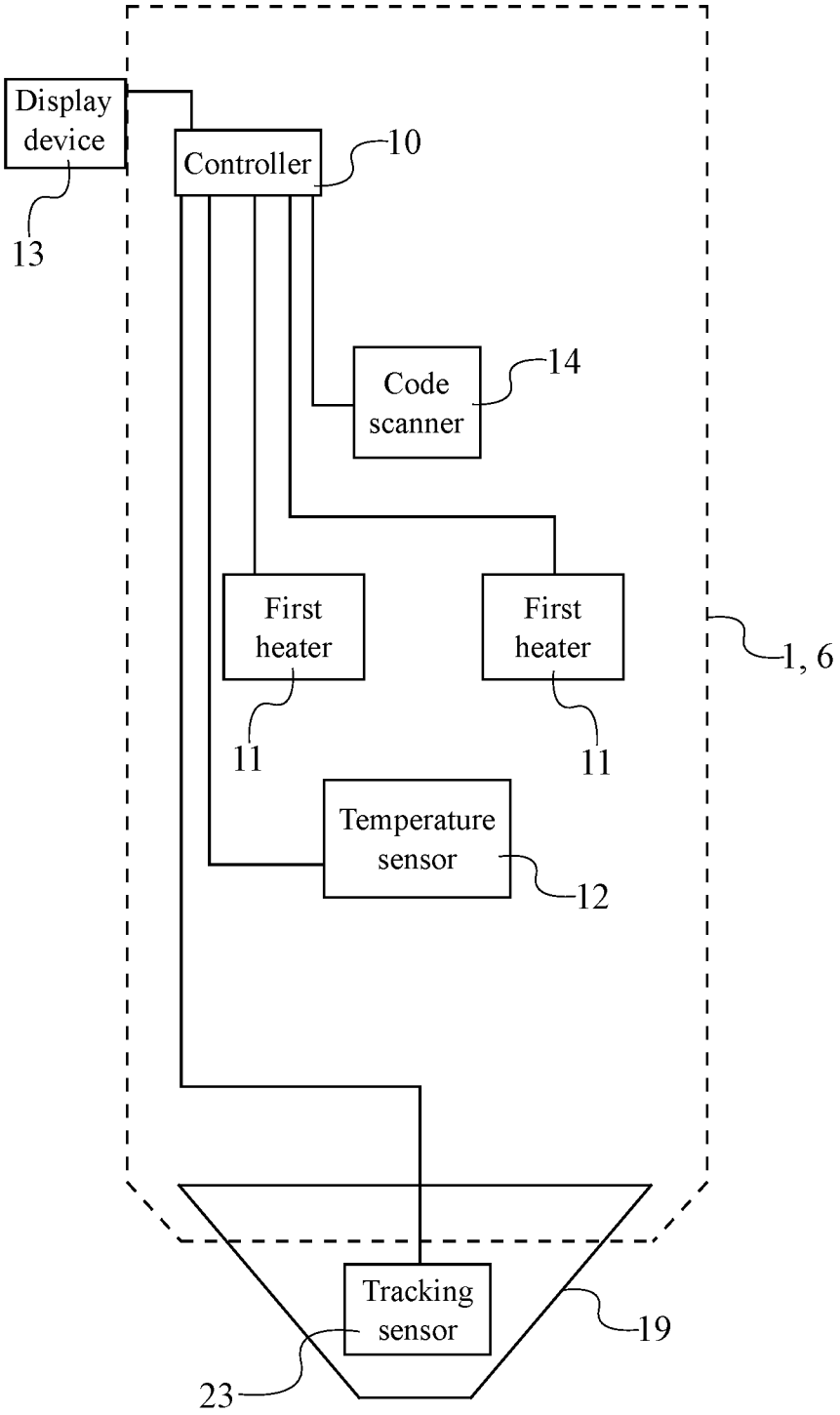
FIG. 9 is a schematic diagram illustrating the electronic connections of the present invention.

With reference to FIG. 9, each of the plurality of wax cartridges 17 may further comprise a tracking sensor 23, and each of the plurality of elongated heating cases 1 comprises a controller 10. The tracking sensor 23 is used to digitally track the location of the drawing tip 19 on paper and the color of the wax or similar crayon material being used. The tracking sensor 23 may be a pressure sensor or motion tracking sensor 23 that can digitally record the strokes made when using the present invention. The tracking sensor 23 is integrated into the drawing tip 19. This arrangement properly positions the tracking sensor 23 in order to effectively track the stroke information when the present invention is used. The controller 10 is used to manage the electronic components of the present invention. Furthermore, the tracking sensor 23 is electronically connected to the controller 10 in order for the controller 10 to receive and process the date collected by the tracking sensor 23. Additionally, the controller 10 stores information recorded by the tracking sensor 23 in order to reproduce artwork that is created by the user through the present invention.

Figure 7:
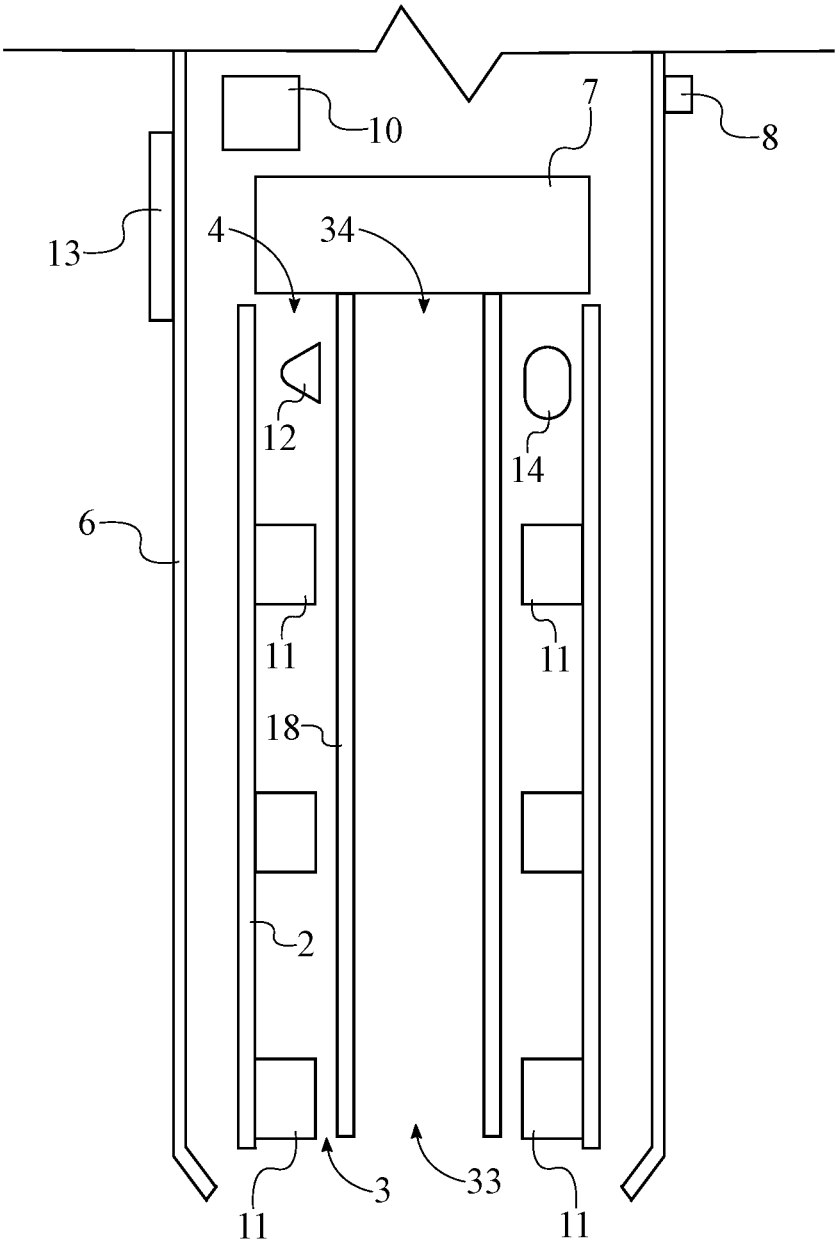
FIG. 7 is schematic diagram illustrating the internal components of the elongated heating case.

With reference to FIG. 7, each of the plurality of elongated heating cases 1 further comprises a plurality of first heaters 11. The plurality of first heaters 11 may be any type of heating devices used to heat the wax or similar crayon material placed inside the at least one selected cartridge 171. The heating tube 2 comprises a receiving end 3 and an exhaust end 4. The receiving end 3 and the exhaust end 4 are reference ends of the heating tube 2. The plurality of first heaters 11 is laterally mounted within the heating tube 2, distributed along the heating tube 2, and positioned offset from the exhaust end 4. This arrangement properly positions and distributed the plurality of first heaters 11 in order to provide heat to wax or similar crayon material that is most near the drawing tip 19 of the at least one selected cartridge 171. With reference to FIG. 9, the controller 10 and the heating tube 2 are mounted within the heat-insulated shell 6. This arrangement properly maintains the heating tube 2 and the controller 10 inside of the heat-insulated shell 6. The controller 10 is electronically connected to each of the plurality of first heaters 11 in order for the controller 10 to properly manage the plurality of first heaters 11 when the present invention is in use. In order for the present invention to be used as quickly as possible after the wax or similar crayon material is heated, the plurality of first heaters 11 is configured to increase in temperature from the exhaust end 4 to the receiving end 3. In more detail, the wax or similar crayon material most near the drawing tip 19 is heated at higher temperatures in order for melted wax to be readily and quickly dispensed by the drawing tip 19.

With reference to FIGS. 7 and 9, each of the plurality of elongated heating cases 1 further comprises at least one temperature sensor 12 and a display device 13. The at least one temperature sensor 12 is used to monitor the heat produced by the plurality of first heaters 11 and to monitor the temperature of the wax or similar crayon material placed inside the at least one selected cartridge 171. The display device 13 is used to notify the user when the wax or similar crayon material is at a melting temperature therefore also notifying the user when the present invention is ready to use. The at least one temperature sensor 12 is mounted within the heating tube 2 in order to properly maintain the temperature sensor inside the heating tube 2. The display device 13 is integrated into the heat-insulated shell 6 in order for the user to visually be notified when the present invention is ready to use. In further detail and in the preferred embodiment of the present invention, the display device 13 is a light-emitting diode (LED) light. The LED light may be used to notify the user when the activated case is heating the selected cartridge 171 or when the present is ready to use. For example, the LED may pulse when the activated case is heating the selected cartridge 171 and be solid when the present invention is ready to use. Furthermore, the at least one temperature sensor 12 and the display device 13 are electronically connected to the controller 10 so that a temperature reading can be made by the at least one temperature sensor 12, process by the controller 10, and then received and displayed by the display device 13.

With reference to FIGS. 7 and 9, each of the plurality of elongated heating cases 1 further comprises a code scanner 14. The code scanner 14 is used to scan codes of the wrappers of the wax or similar crayon material. The codes may be any type of codes such as, but not limited to, quick response (QR) codes or barcodes that can be scanned by the code scanner 14. The codes may contain information such as, but not limited to, the type of wax or similar crayon material or the color of the wax or similar crayon material. The code scanner 14 is mounted within the heating tube 2 in order to properly maintain the code scanner 14 inside the heating tube 2. Furthermore, the code scanner 14 is electronically connected to the controller 10 in order for the controller 10 to manage and communicate with the code scanner 14.

With reference to FIG. 6, each of the plurality of elongated heating cases 1 further comprises a spring-loaded gravity-activated sealing mechanism 15 that prevents melted wax from spilling or leaking out of the at least one activated case when the present invention is tilted from 45 degrees to an upside-down orientation. The spring-loaded gravity-activated sealing mechanism 15 comprises a first mechanism end 37 and a second mechanism end 38. The first mechanism end 37 is a spring that is mounted within the heat-insulated shell. The second mechanism end 38 is a silicone plug that is positioned adjacent to the exhaust end. This arrangement properly positions the spring-loaded gravity-activated sealing mechanism 15 in order to prevent spilling or leakage of melted wax. In the preferred embodiment of the present invention, the spring-loaded gravity-activated sealing mechanism 15 includes a barbell in the silicon plug. The barbell is positioned at the center of the silicone plug and can move freely up and down. The barbell is composed of heat-conductive material such that if any wax is stuck to a sealing point or a small ball of the barbell, the wax can melt off the barbell when heated. The conical shape of a cavity of the barbell allows a heavy ball of the barbell to slide sideways and out as the present invention is turned 45 degrees. This arrangement also moves the small ball, since it's connected via the bar, to plug the air hole, thus preventing any wax from escaping. When the present invention is upright again, the heavy ball moves back down into the cavity and thus moves the small ball down, opening the seal. So, if the present invention is slowly turned 45 degrees or rapidly turned upside down, the spring-loaded gravity-activated sealing mechanism 15 will keep things sealed. Wax only touches one hemisphere of the small ball and prevents gumming up of the spring-loaded gravity-activated sealing mechanism 15.

In another embodiment of the present invention, to substitute the spring-loaded gravity-activated sealing mechanism 15, the present invention may further comprise a plug made of a semi-permeable membrane. In this embodiment, the plug blocks melted wax from flowing outside of the at least one selected cartridge 171 when the present invention is tilted or held upside down. Furthermore, the plug lets air flow into the at least one selected cartridge 171 when the melted wax is dispensed from the drawing tip 19 in a right-side up orientation and prevents the formation of a vacuum inside the at least one selected cartridge 171. It is important to prevent this vacuum from forming inside the at least one selected cartridge 171 as it would prevent a smooth outflow of melted wax from the drawing tip 19.

Figure 3:
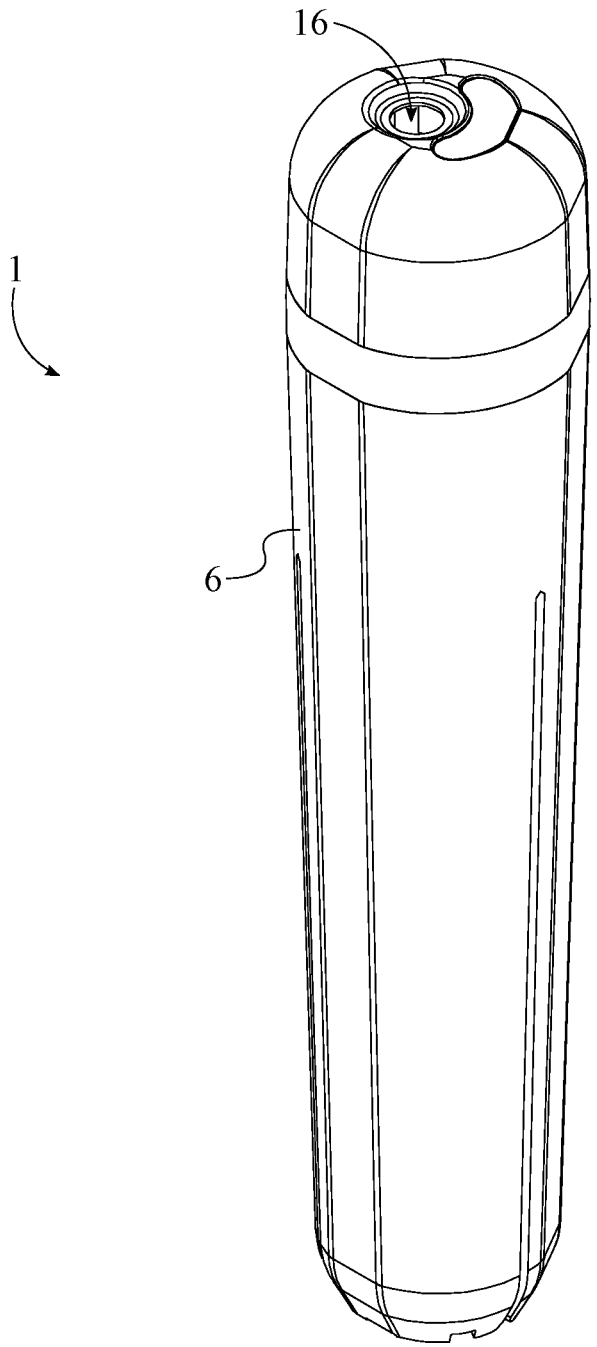
FIG. 3 is a perspective view of the elongated heating case.
Figure 10:
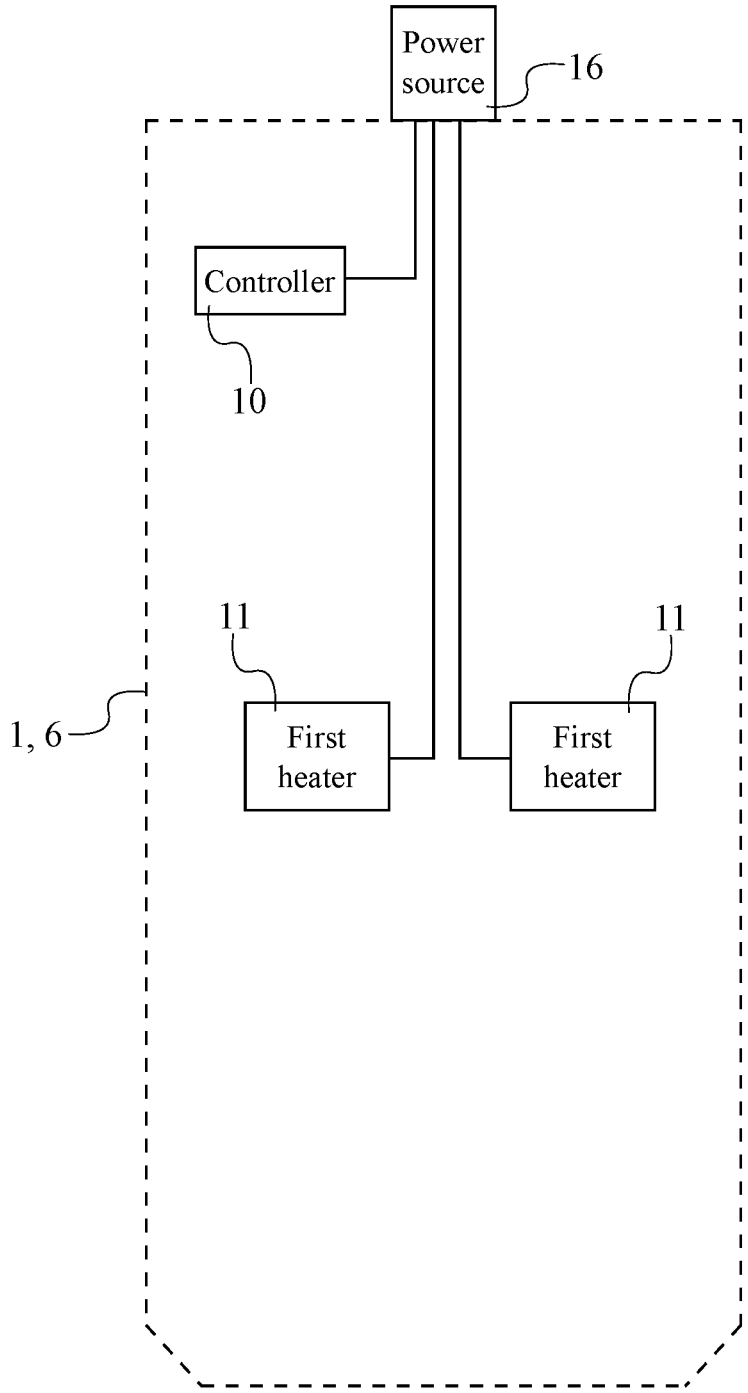
FIG. 10 is a schematic diagram illustrating the electrical connections of the present invention.

With reference to FIGS. 3 and 10, each of the plurality of heating cases further comprises a power source 16 that is used to power the electronic components of the present invention. The plurality of first heaters 11 and the controller 10 are electrically connected to the power source 16 in order to receive electrical energy from the power source 16. In one embodiment of the present invention, the power source 16 may a power input which can receive any type of power cord in order to receive and provide electrical energy. In another embodiment of the present invention, the power source 16 may be a replaceable or rechargeable battery. The replaceable or rechargeable battery may be mounted inside the heat-insulated shell 6 in order to properly maintain the power source 16 inside the elongated heating case 1.

Figure 5:
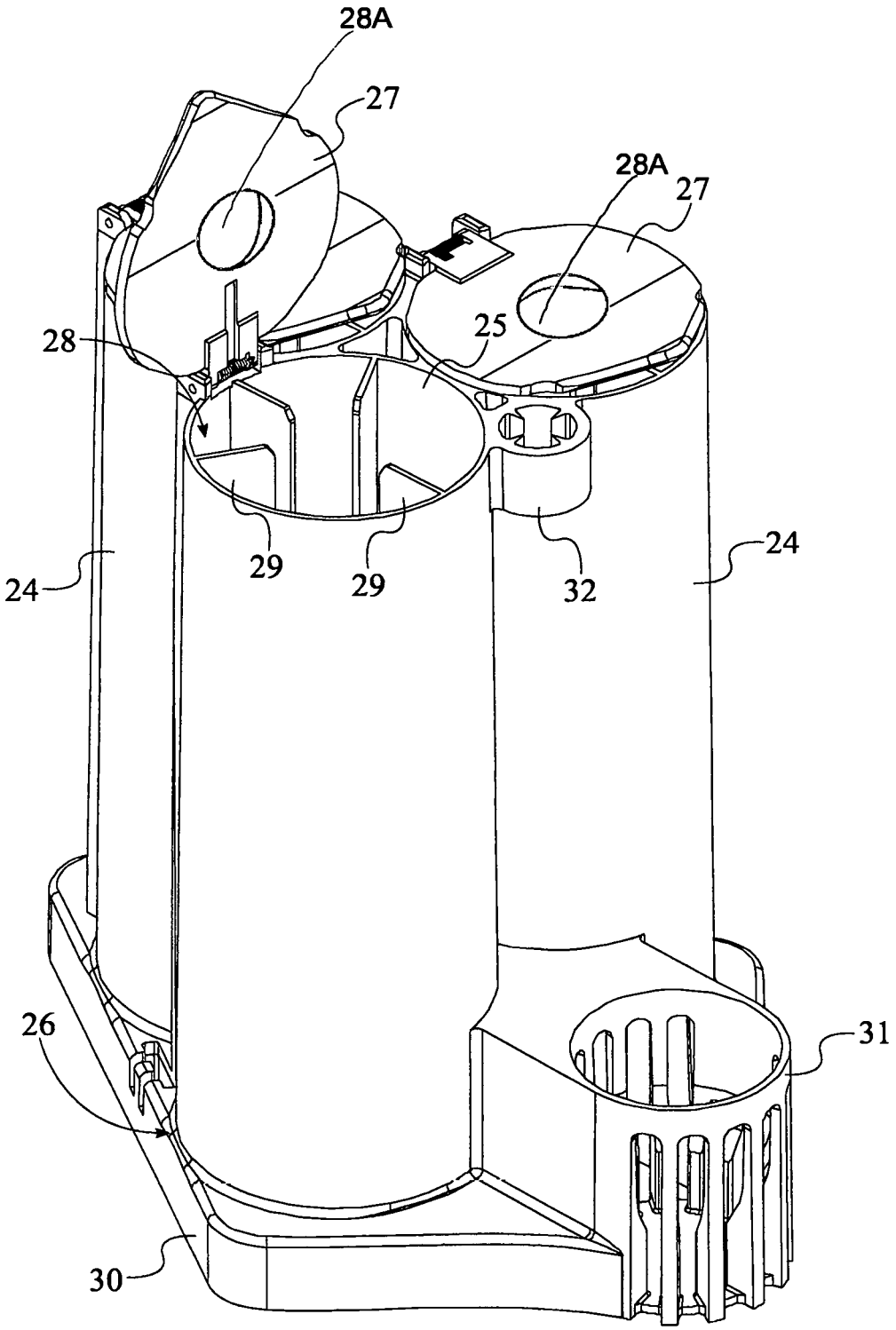
FIG. 5 is a perspective of the transfer canisters, the pen-docking canister, and the docking panel.

With reference to FIG. 5, the present invention may further comprise a docking panel 30 which provides a flat structure in order to rest the present invention on a table or other flat surface. The base 26 of each of the plurality of transfer canisters 24 is connected onto the docking panel 30. This arrangement properly positions the plurality of transfer canisters 24 to receive the plurality of unselected wax cartridges 172. The present invention may further comprise at least one pen-docking canister 31. The at least one pen-docking canister 31 is used to hold the at least one activated case while the user waits for the at least one activated case to heat the at least one selected cartridge 171 in order the present invention to be ready to use. Additionally, the at least one pen-docking canister 31 is used to store a corresponding elongated heating case that is not being used.

The docking panel 30 may further comprise a female connection and a male connection. The female connection and the male connection allow multiple docking panels 30 to be connected to each other. The female connection and the male connection are integrated into the docking panel 30. Furthermore, the female connection and the male connection are positioned opposite to each other. This arrangement allows the user to connect multiple docking panels 30 in series with each other through the female connection and the male connection.

Figure 8:
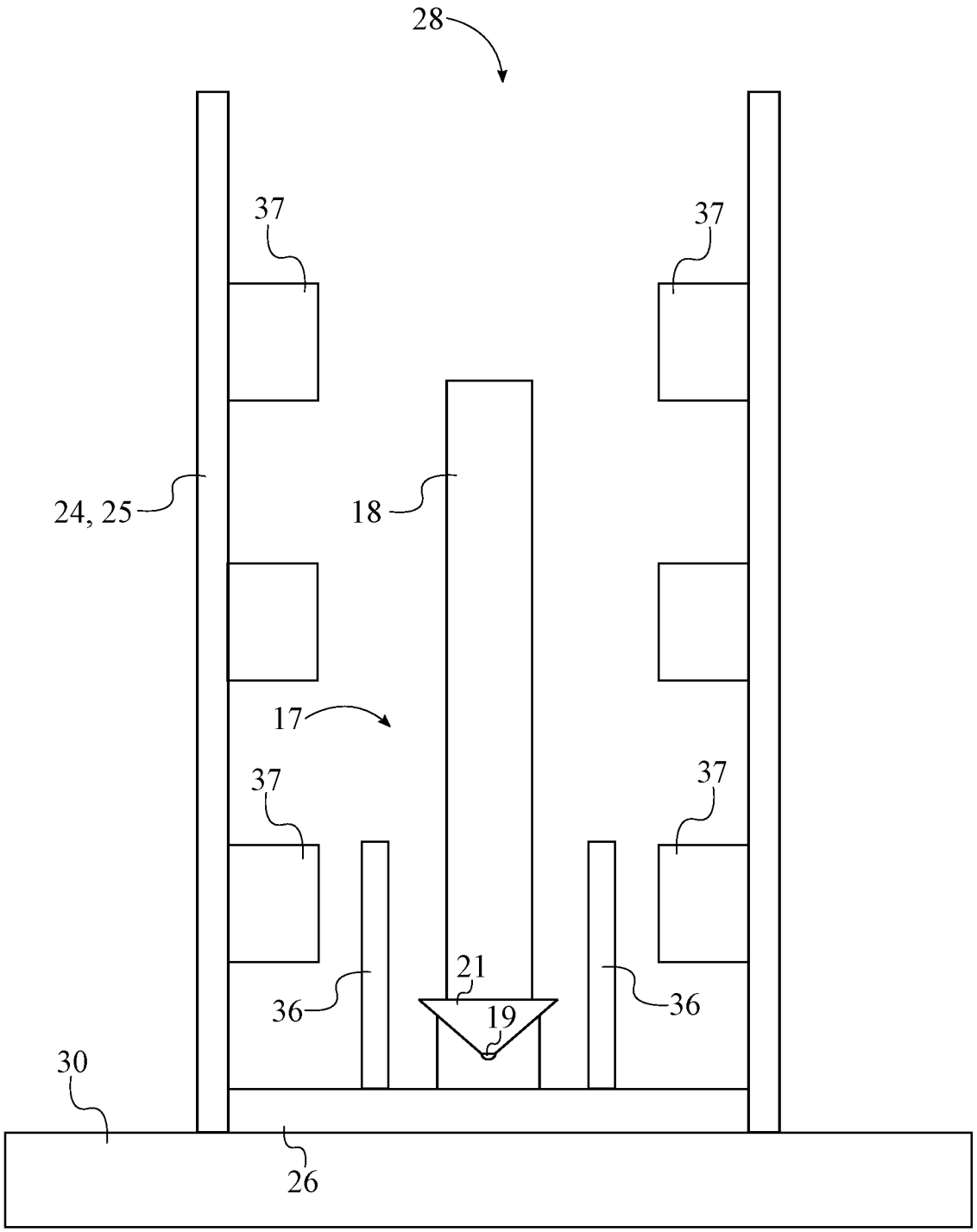
FIG. 8 is a schematic diagram illustrating the internal components of the transfer canister.

With reference to FIGS. 5 and 8, each of the plurality of transfer canisters 24 comprises a tubular wall 25, a base 26 and a plurality of prongs 36. The tubular wall 25 and base 26 are structural parts of the transfer canister. The base 26 is terminally positioned to the tubular wall 25, and the tubular wall 25 is perimetrically connected around the base 26. This arrangement forms the proper structural shape of a transfer canister. The plurality of prongs 36 is connected normal onto the base 26. The plurality of prongs 36 is used to actuate the prong-actuated push mechanism 9 for the activated case to be engaged to or disengaged from the selected cartridge 171. In further detail, the plurality of prongs 36 provides an upward force to the push rods when the activated case is pressed into the corresponding canister of the selected cartridge 171. This consequently actuates the cam-type rotation mechanism 35 to move into a first rest state which engages each of the plurality of spring-loaded latches 5 of the activated case to the corresponding plate from the plurality of strike plates 20 of the activated case. This allows the user to pull the activated case from the corresponding canister of the selected cartridge 171 with the selected cartridge 171 engaged to the activated case. In order for the user to disengage the selected cartridge 171, the user may press the activated case, with the selected cartridge 171 engaged, into the corresponding canister of the selected cartridge 171, which provides an upward force to the push rods and consequently actuates the cam-type rotation mechanism 35 to move in a second rest state. This disengages each of the plurality of spring-loaded latches 5 of the activated case from the corresponding plate from the plurality of strike plates 20 of the selected cartridge 171. Moreover, the spring from the spring-loaded gravity-activated sealing mechanism 15 provides a force which aids to eject the selected cartridge 171 from the activated case. Furthermore, the selected cartridge 171 is maintained in the corresponding canister by the O-ring which prevents friction between the activated case and the selected cartridge 171 when the user removes the activated case from the corresponding canister of the selected cartridge 171.

Furthermore and with reference to FIG. 5, each of the plurality of transfer canisters 24 comprises a lid 27 and an opening 28. The opening 28 is positioned opposite to the base 26 along the tubular wall 25. This arrangement properly positions the opening 28 as a reference point of the transfer canister. The lid 27 is hingedly connected to the tubular wall 25, adjacent to the opening 28. In another embodiment of the present invention, the hinged connection between the lid 27 and the tubular wall 25 is spring loaded which automatically closes the lid 27 for safety purposes when the user is not manually lifting the lid 27. This arrangement allows the user to reveal and conceal the opening 28 by rotating the lid 27 onto or away from the opening 28. Additionally, each of the plurality of transfer canisters 24 may further comprise a stick-receiving opening 28A. The stick-receiving opening 28A allows a user to safely insert wax or similar crayon material into a wax cartridge. The stick-receiving opening 28A traverses through the lid 27 and is centrally positioned to the lid 27. This arrangement properly positions the stick-receiving opening 28A in order for wax or similar crayon material to be easily inserted into a wax cartridge.

Moreover and with reference to FIG. 5, the plurality of transfer canisters 24 comprises a plurality of guide rails 29 in order to properly guide the activated case into the corresponding canister of the selected cartridge 171 in order to engage the selected cartridge 171 with the activated case. The plurality of guide rails 29 is positioned within and along the tubular wall 25 and laterally connected to the tubular wall 25. This arrangement properly positions the plurality of guide rails 29 within the transfer canister. Moreover, each of the plurality of elongated heating cases 1 further comprises a plurality of guide slits. The plurality of guide slits laterally traverses into the heat-insulated shell 6. Each of the plurality of guide slits may be engaged to a corresponding rail of the plurality of guide rails 29. The plurality of guide slits and the plurality of guide rails 29 allow the user to properly insert the activated case into the corresponding canister of the selected cartridge 171.

With reference to FIG. 8, each of the plurality of transfer canisters 24 further comprises a plurality of second heaters 37. The plurality of second heaters 37 is used to heat the inside of each of the plurality of transfer canisters 24. In further detail, the wax or similar crayon material may be inserted into any wax cartridge from the plurality of wax cartridges 17 and be heated by the plurality of second heaters 37 while inside a corresponding canister. The plurality of second heaters 37 is mounted within the tubular wall 25 and distributed along the tubular wall 25. This arrangement properly positions the plurality of second heaters 37 inside each of the plurality of transfer canisters 24 in order to uniformly heat the corresponding wax cartridge from the plurality of unselected wax cartridges 172.

With reference to FIG. 5, the present invention may further comprise a wrapper cutter 32 which is used to peel of the wrapper paper from the wax or similar crayon material. The wrapper cutter 32 is connected in between two specific canisters from the plurality of transfer canisters 24 and positioned offset from a base 26 for each of the two specific canisters. This arrangement tactically positions the wrapper cutter 32 in order to peel of the wrapper paper from the wax or similar crayon material in order for it be inserted inside of a wax cartridge.

Although the invention has been explained in relation to its preferred embodiment, it is to be understood that many other possible modifications and variations can be made without departing from the spirit and scope of the invention as hereinafter claimed.

What is claimed is:

1. A system for aesthetically dispensing melted wax for the purposes of drawing, coloring, sketching and artwork comprises:

a plurality of elongated heating cases;

a plurality of wax cartridges;

a plurality of transfer canisters;

the plurality of wax cartridges comprises at least one selected cartridge and a plurality of unselected wax cartridges;

each of the plurality of unselected wax cartridges being mounted within a corresponding canister from the plurality of transfer canisters; and the at least one selected cartridge being operatively engaged into at least one activated case from the plurality of elongated heating cases, wherein the at least one activated case is used to hold and heat the at least one selected cartridge wherein each of the plurality wax cartridges comprises a heat-receiving tube, a drawing tip, and a plurality of strike plates;

the heat-receiving tube comprises a first open end and a second open end;

the drawing tip being in fluid communication with the heat-receiving tube;

the drawing tip being mounted adjacent to the first open end;

the plurality of strike plates being connected around the drawing tip; and the plurality of strike plates being oriented towards the second open end.

2. The system for aesthetically dispensing melted wax as claimed in claim 1 comprises:

the drawing tip for each of the plurality of unselected wax cartridges being mounted onto a base of the corresponding canister.

3. The system for aesthetically dispensing melted wax as claimed in claim 1 comprises:

each of the plurality of elongated heating cases comprises a heating tube, a prong-actuated push mechanism, a cam-type rotation mechanism, and a plurality of spring-loaded latches;

the heat-receiving tube of the at least one selected cartridge being sleeved by the heating tube of the at least one activated case;

the drawing tip of the at least one selected cartridge being terminally positioned to the heating tube of the at least one activated case;

the prong-actuated push mechanism being operatively coupled to the cam-type rotation mechanism, wherein the prong-actuated push mechanism is used to input linear motion into the cam-type rotation mechanism; and the cam-type rotation mechanism being operatively coupled to each of the plurality of spring-loaded latches, wherein the cam-type rotation mechanism is used to output motion to selectively engage or disengage each of the plurality of the spring-loaded latches of the at least one activated case to a corresponding plate from the plurality of strike plates of the at least one selected cartridge.

4. The system for aesthetically dispensing melted wax as claimed in claim 1 comprises:

each of the plurality of wax cartridges further comprises a drawing barrel;

each of the plurality of heating cases comprises a heat-insulated shell, a cam-type retraction mechanism, and an actuation button;

the drawing barrel being connected adjacent to the first open end;

the drawing tip being slidably mounted within the drawing barrel;

the cam-type retraction mechanism being mounted within the heat-insulated shell;

the actuation button being externally integrated into the heat-insulated shell;

the second open end of the at least one selected cartridge being operatively engaged to the cam-type retraction mechanism of the at least one activated case, wherein the cam-type retraction mechanism is used to retract the drawing tip into the drawing barrel or is used to extend the drawing tip out of the drawing barrel; and the actuation button being operatively coupled to the cam-type retraction mechanism, wherein the actuation button is used to actuate the cam-type retraction mechanism.

5. The system for aesthetically dispensing melted wax as claimed in claim 1 comprises:

each of the plurality of wax cartridges further comprises a ballpoint valve; and the ballpoint valve being operatively integrated into the drawing tip, wherein the ballpoint valve is used to selectively dispense melted wax from the drawing tip.

6. The system for aesthetically dispensing melted wax as claimed in claim 1 comprises:

each of the plurality of wax cartridges further comprises a tracking sensor;

each of the plurality of heating cases comprises a controller;

the tracking sensor being integrated into the drawing tip; and the tracking sensor being electronically connected to the controller.

7. The system for aesthetically dispensing melted wax as claimed in claim 1 comprises:

each of the plurality of elongated heating cases comprises a heating tube, a plurality of first heaters, a controller, and a heat-insulated shell;

the heating tube comprises a receiving end and an exhaust end;

the plurality of first heaters being laterally mounted within the heating tube;

the plurality of first heaters being distributed along the heating tube;

the plurality of first heaters being positioned offset from the exhaust end;

the controller and the heating tube being mounted within the heat-insulated shell; and the controller being electronically connected to each of the plurality of first heaters.

8. The system for aesthetically dispensing melted wax as claimed in claim 7 comprises:

the plurality of heaters being configured to increase in temperature from the exhaust end to the receiving end.

9. The system for aesthetically dispensing melted wax as claimed in claim 7 comprises:

each of the plurality of elongated heating cases further comprises at least one temperature sensor and a display device;

the at least one temperature sensor being mounted within the heating tube;

the display device being integrated into the heat-insulated shell; and the at least one temperature sensor and the display device being electronically connected to the controller.

10. The system for aesthetically dispensing melted wax as claimed in claim 7 comprises:

each of the plurality of elongated heating cases further comprises a code scanner;

the code scanner being mounted within the heating tube; and the code scanner being electronically connected to the controller.

11. The system for aesthetically dispensing melted wax as claimed in claim 7 comprises:

each of the plurality of elongated heating cases further comprises a spring-loaded gravity-activated sealing mechanism;

the spring-loaded gravity-activated sealing mechanism comprises a first mechanism end and a second mechanism end;

the first mechanism end being mounted within the heat-insulated shell; and the second mechanism end being positioned adjacent to the exhaust end.

12. The system for aesthetically dispensing melted wax as claimed in claim 7 comprises:

each of the plurality of heating cases further comprises a power source; and the plurality of heaters and the controller being electrically connected to the power source.

13. The system for aesthetically dispensing melted wax as claimed in claim 1 comprises:

each of the plurality of transfer canisters comprises a tubular wall, a base, and a plurality of prongs;

the base being terminally positioned to the tubular wall;

the tubular wall being perimetrically connected around the base; and the plurality of prongs being connected normal onto the base.

14. The system for aesthetically dispensing melted wax as claimed in claim 13 comprises:

each of the plurality of transfer canisters comprises a lid and an opening;

the opening being positioned opposite to the base along the tubular wall; and the lid being hingedly connected to the tubular wall, adjacent to the opening.

15. The system for aesthetically dispensing melted wax as claimed in claim 13 comprises:

each of the plurality of transfer canisters comprises a plurality of guide rails;

the plurality of guide rails being positioned within and along the tubular wall; and the plurality of guide rails being laterally connected to the tubular wall.

16. The system for aesthetically dispensing melted wax as claimed in claim 13 comprises:

each of the plurality of transfer canisters further comprises a plurality of second heaters;

the plurality of second heaters being mounted within the tubular wall; and the plurality of second heaters being distributed along the tubular wall.

17. The system for aesthetically dispensing melted wax as claimed in claim 1 comprises:

a wrapper cutter;

the wrapper cutter being connected in between two specific canisters from the plurality of transfer canisters; and the wrapper cutter being positioned offset from a base for each of the two specific canisters.

* * * * *